United States Patent [19]

Chadshay

[11] 4,425,855

[45] Jan. 17, 1984

[54] SECONDARY AIR CONTROL DAMPER ARRANGEMENT

[75] Inventor: Roman Chadshay, Windsor, Conn.

[73] Assignee: Combustion Engineering, Inc., Windsor, Conn.

[21] Appl. No.: 471,975

[22] Filed: Mar. 4, 1983

[51] Int. Cl.[3] ..... F23D 1/00; F23K 3/02

[52] U.S. Cl. ..... 110/263; 110/265; 110/347; 110/106

[58] Field of Search ..... 110/347, 260–265, 110/106 R, 232

[56] References Cited

U.S. PATENT DOCUMENTS

| | | | |
|---|---|---|---|
| 1,762,462 | 6/1930 | Andrews | 110/232 |
| 4,246,853 | 1/1981 | Mehta | 110/347 |
| 4,274,343 | 6/1981 | Kokkinos | 110/347 |
| 4,294,178 | 10/1981 | Borio et al. | 110/347 |
| 4,304,196 | 12/1981 | Chadshay | 110/347 |

*Primary Examiner*—Henry C. Yuen

*Attorney, Agent, or Firm*—Arthur L. Wade

[57] ABSTRACT

The outline of a tangentially-fired furnace combustion chamber is arranged to show a representative windbox in one corner of the furnace. The secondary air is disclosed as supplied through one set of vertically tiltable nozzles mounted in the windbox. The secondary air supply conduit is mounted to feed the tiltable nozzles. The secondary air supply conduit section adjacent to the nozzles has straightening vanes forming channels in which independently controlled louvers regulate the total cross-sectional area of the channels to maintain the desired velocity of the secondary air through the nozzles.

5 Claims, 3 Drawing Figures

SECONDARY AIR CONTROL DAMPER ARRANGEMENT

TECHNICAL FIELD

The present invention relates to regulating the velocity and distribution of the secondary air in a tangentially-fired furnace to control its combustion. More particularly, the invention relates to controlling the effective openings of a secondary air nozzle as an orifice in regulation of the secondary air supplied to the nozzle to effect the desired velocity and distribution of the secondary air from the nozzle.

BACKGROUND ART

The literature on the art of NOx and slag control in industrial and utility furnaces is the Leslie Pruce article "Reducing NOx Emissions At The Burner, In The Furnace, And After Combustion" appearing on pages 33–40 of the January 1981 issue of Power. This article is a comprehensive treatise dealing with the burner and furnace configurations and fuels which are factors in NOx production and control. It will serve little purpose to review all the facets of this article. What is important lies in the reference to the tangentially-fired industrial and utility furnaces in which the primary and secondary combustion air can be controlled in its quantity, velocity, and direction.

In the tangentially-fired furnace, the so-called fireball is generated by directing the burner discharge to one side of the vertical axis of the furnace to create a swirling mass of combustion. The secondary air can be proportioned between the combustion of the fireball and the outside of the fireball, which is the annulus between the fireball and the walls of the furnace.

The general objective of NOx control is to maintain the flame temperature of the fireball within certain limits. Another way of expressing this limit is the specification that the fireball will be maintained in a fuel-rich combustion, while the combustion at the periphery of the fireball will be maintained air-rich. Thus, the overall flame temperature will be held to a level which will militate against the formation of NOx.

NOx, of course, is generated with the nitrogen of the fuel and the nitrogen of the combustion air. By proportioning the amount of air initially supporting the combustion and the air secondarily entering into the combustion, the resulting NOx of both the fuel and air can be controlled. The operator of the furnace combustion empirically tuns the combustion process by proportioning the amount of secondary air placement relative to the fireball and the annulus between the fireball and the furnace wall.

In general, less than 20% of the secondary air to the fireball will maintain substoichiometric combustion which limits the flame temperature of the fireball and provides the curtain of secondary air over the furnace walls. The curtain of secondary air militates against the formation of slag on the furnace walls. All this proportioning of the air to control both the NOx and the slag requires tools of adjustment available to the furnace operator.

Concomitant with the distribution of secondary air between the fireball combustion and the curtain in the annulus formed by the fireball and the furnace walls, is the problem of maintaining the velocity of these proportions of the secondary air as the load on the furnace changes. It is fundamental that both the quantity of fuel and the quantity of air will be changed as the demand for furnace heat changes. Although the quantities of secondary air may be decreased as load is dropped on the furnace, it may be desirable to maintain the velocity of the decreased secondary air close to that velocity required to maintain combustion in the fireball and/or curtain in the annulus formed by the fireball and furnace walls. In effect, the secondary air nozzles must be constructively changed to maintain the velocity of the secondary air desired for furnace combustion conditions.

The windboxes in the corners of the furnace have the vertically adjustable air nozzles supplied through channels formed by turning vanes which direct the air from conduits arranged along the outside of the furnace wall to the windboxes. The total amount of this air supplied the channels of the turning vanes is controlled by a series of dampers well-developed in the prior art. However, the proportioning and the velocity control of the total air in the channels of the turning vanes has not been provided by controls available during furnace operation. Adjustments of the cross-sectional area of the channel to vary the proportion and velocity has had to await furnace shutdown. An adjustable control element within each vane channel is needed to determine the distribution and velocity of the total combustion air supplied to the nozzle of the windbox in order to quickly control the amount and velocity of air directed to the combustion of the fireball, and the amount and velocity of the air directed to the curtain between the fireball and the furnace wall.

DISCLOSURE OF THE INVENTION

The present invention contemplates an air flow control structure mounted within each channel formed in a windbox to proportion the total air and control the velocity of the air flowing through each channel.

The invention further contemplates a control system operable external the furnace with which to position each air flow control structure in the channels during the operation of the furnace burner in order to change the proportion of combustion air and control the velocity of the air to each channel.

Other objects, advantages and features of this invention will become apparent to one skilled in the art upon consideration of the written specification, appended claims, and attached drawings.

BRIEF DESIGNATION OF THE DRAWINGS

TERMS AND TECHNOLOGY

Figure 1:
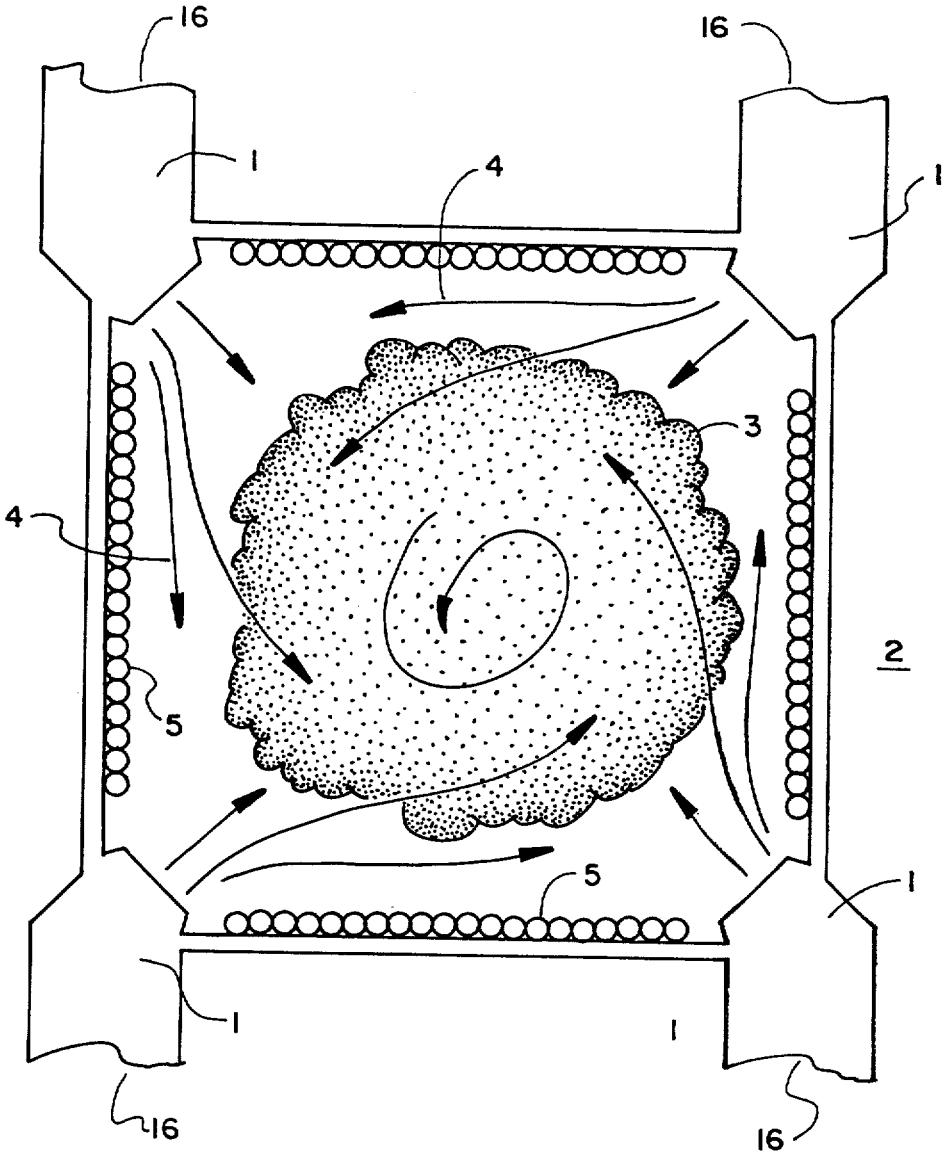
FIG. 1 is a plan view of a tangentially-fired furnace with corner windboxes in which are mounted secondary air supply structures embodying the present invention.

The present invention is inherently associated with the tangentially-fired furnace. Classically, the tangentially-fired furnace, in cross section, is a square box with walls lined with tubes through which water is passed to be heated into steam by the combustion of fuels fed to the furnace. Combustion is in the form of a swirling mass of flames sustained about the vertical midline of the furnace chamber. The fuel nozzles are mounted in windboxes at each corner of the box-shaped chamber and are vertically tiltable while directing their flames to a predetermined number of degrees to one side of the midline to form the fireball. The windboxes are vertically extended frameworks in which the adjustable burners are vertically stacked and sandwiching adjustable nozzles for secondary air. As stated, the horizontal direction of the fuel nozzles is fixed in relation to the centerline of the furnace. The direction and velocity of the secondary air from the air nozzles is the concern of the present invention.

Conduits external the furnace which bring the secondary air to the windboxes are conventionally mounted along the outside of the furnace wall. These secondary air conduits terminate in the air nozzles mounted in the windboxes. Necessarily, the conduits must make a sharp turn into the windboxes by means of a transition section to couple with the nozzles. It has been the practice to mount a series of parallel baffles, termed turning vanes, in the transition section of the conduits forming channels which smoothly direct the secondary air to the nozzle orifices of the windboxes.

The number of turning vanes can be more than 2, but it is common practice to utilize two vertical vanes to divide the conduit into three parallel channels upstream of the nozzles. The entrance of these three channels is controlled by a damper, or louver, which is movable to maintain the desired overall obstruction to the flow of secondary air to all the nozzles. The amount of total air required is dependent upon the demand for heat on the furnace and is not of present concern. The present invention is concerned with the distribution and velocity of this total secondary air among the channels defined by the turning vanes downstream of the total air control damper or louver.

The air flow control structure provided in each of the channels may be termed a louver or damper. The channels may be additionally divided by a horizontal partition and a separate damper or louver provided for each division of the channel. A separate control system may be provided for each louver or damper within each channel to establish the effective orifice opening of the nozzles supplied secondary air from each subdivision of each channel. Thus, the distribution and velocity of the total secondary air to the various openings of the nozzle supplied by the subdivisions of the channels will be controlled to carry out the objects of the invention.

The ultimate objective of the invention is to divide the secondary air from the nozzles between the fireball and the curtain between the fireball and the walls of the furnace, while regulating the velocity of each division. The second set of air flow controls implements a change in the air exit velocities, hence the change of momenta without the change of the required air mass thus altering the shape, also the position of the fireball. With the invention, this distribution is determined and adjustable by menas provided an operator from a position external the furnace. Thus, the operator is provided a tool with which to tune the secondary air distribution and velocity and thereby control the NOx generated in the combustion chamber, the slag precipitated upon the walls of the combustion chamber, and the combustion characteristics as the furnace load varies.

BEST MODE FOR CARRYING OUT THE INVENTION

Furnace Organization

Figure 2:
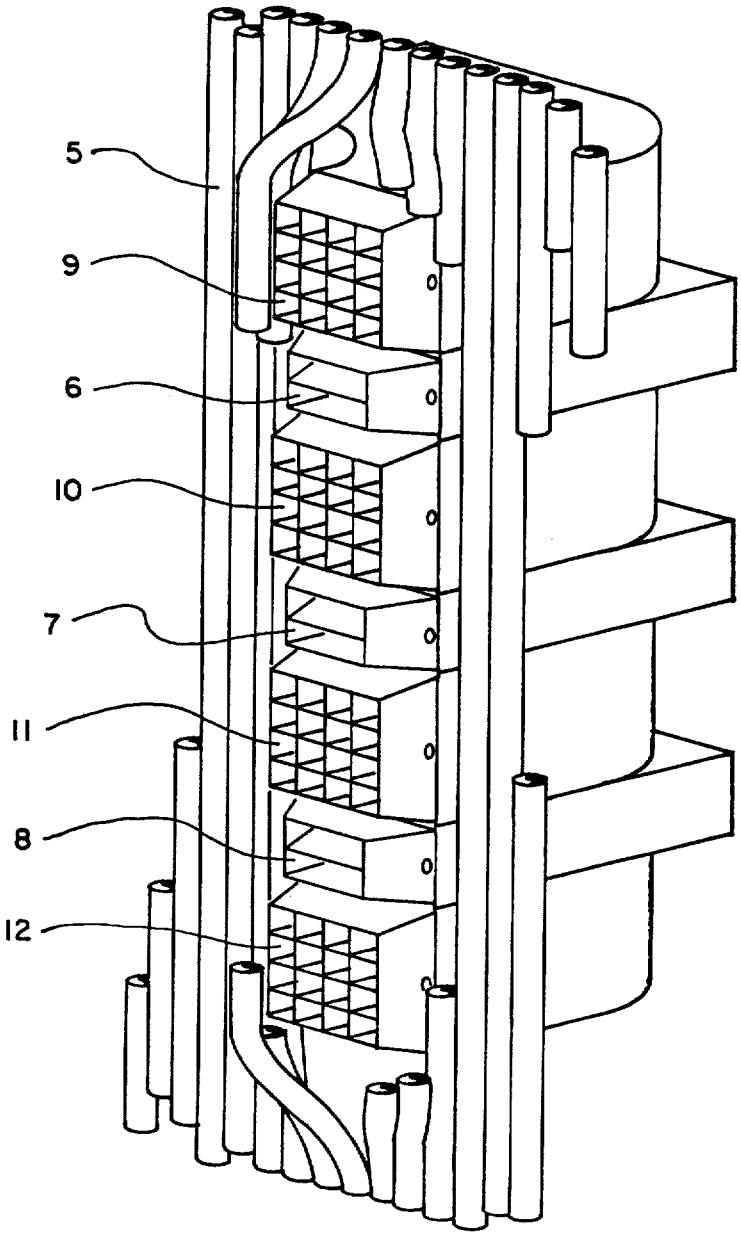
FIG. 2 is a perspective of a portion of the windbox viewed from inside the furnace, disclosing the secondary air supply in relation to fuel nozzles.
Figure 3:
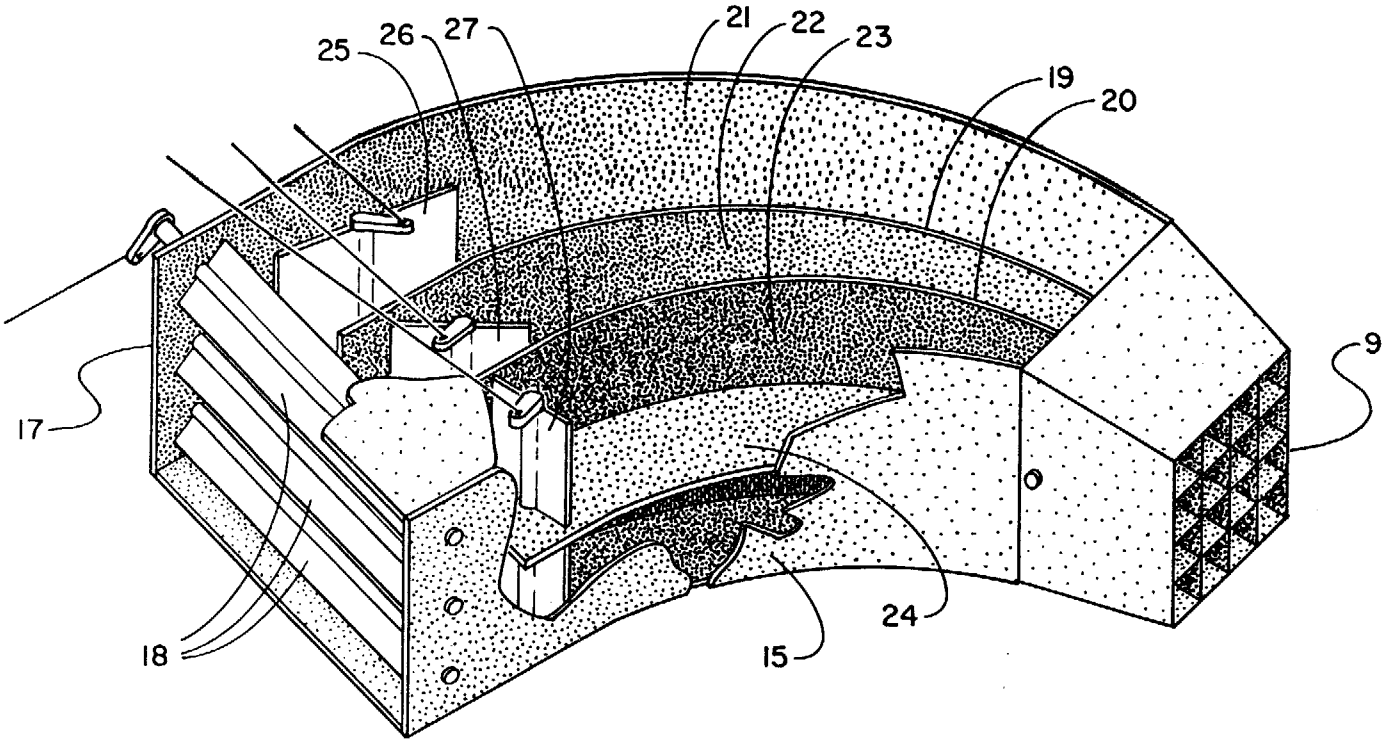
FIG. 3 is a perspective of a partially sectioned transition conduit through which secondary air supplies the nozzles of the windbox.

FIG. 1 is planned to disclose the relation of the windboxes 1 at each corner of furnace 2 as fireball 3 is generated by combustion of the fuel and air discharged from the windboxes. As is conventional, each windbox 1 mounts a series of vertically stacked fuel nozzles discharging their mixtures of fuel and primary air. Between each fuel nozzle in the windbox, is mounted nozzles for directing the secondary air necessary to complete the combustion. FIG. 1 discloses this general positional relationship between windboxes 1, walls of furnace 2, and fireball 3. FIG. 2 discloses a section of a single windbox 1 with its vertically arranged fuel nozzles and secondary air discharges. FIG. 3 discloses a single set of secondary air nozzles as connected to the end of a transition section which couples the air nozzles to their conduit through which air is brought to the furnace.

In FIG. 1 it is evident that fireball 3 is a swirling mass of flame brought into being by the ignition of pulverized solid fuel (coal) and the air necessary to support its combustion. The fuel nozzles of each windbox 1 tilt vertically, but discharge their mixture of primary air and fuel a few degrees to one side of the vertical centerline of furnace 2. Just how many degrees these fuel nozzles discharge to one side of the centerline determines the size and rotational velocity of fireball 3. Into this swirling mass of flame, a portion of the total secondary air is injected at a predetermined velocity to product just the degree of combustion required in relation to stoichiometric conditions. The remainder of the secondary air is directed with the velocity to form a curtain 4 of such air between fireball 3 and the inside walls of furnace 2. This curtain 4 encapsulates the fireball while rotating in the same direction and functions to militate against the impingement of slag on the tubes 5 with which the walls of the furnace are lined.

The ultimate objective of the invention begins to emerge. The control of the velocity of the secondary air and its division between the fireball 3 and the curtain 4 is sought by the present invention. Heretofore, the furnace operator has had no means with which to continuously adjust the directions and velocities of the divisions of the secondary air from outside the furnace and while the furnace is in operation.

FIG. 2 discloses the wall of water-containing tubes 5 and how they are distorted to provide for the discharge of fuel and air from windbox 1. The fuel nozzles 6, 7 and 8 are vertically stacked as supported within windbox 1. Between each pair of fuel nozzles is mounted secondary air nozzles 9, 10, 11 and 12. So mounted, these fuel and air nozzles spew their air and solid fuel tangent to the walls of furnace 2.

Transition Section

FIG. 3 discloses a single secondary air nozzle set 9 with multiple openings and gives the detail of how the air is brought to transition section 15 by a source conduit not shown in FIG. 3. The conduits for fuel and air are indicated in FIG. 1 at 16. One of the secondary air conduits terminates at the end 17 of transition section 15. The total secondary air into transition section 15 is controlled by a set of louvers 18. Discursively, louvers 18 give an overall regulation of the total secondary air passed through transition section 15 to be discharged through nozzle set 9.

The tiltable nozzle set 9 can be considered a fixed orifice. The velocity of the air discharged from this nozzle set into the furnace is dependent on the pressure of the air in the transition section immediately downstream of louvers 18. The transition section-furnace differential is established by setting the fan pressure of conduit 16, and the setting of the secondary air louvers 18. This is the pressure under which the air enters the transition section. It does not mean that the same pressure exists in the transition section; it is usually much lower if the louvers 18 are partially closed. Although the amount of air entering the transition section is adequate, when the pressure is low, the exit velocity from the nozzle set 9 will be lower than required either to penetrate or direct the air relative to the fireball. Therefore, it is the air flow control structures embodying the present invention which function to provide the equivalent of variable orifices to selectively increase the pressure inside the channels of the transition section to provide proper velocity in directing the air to the desired section of the nozzle set 9 for injection into the furnace.

Aside from the control of the total air passed through transition section 15 by louvers 18, the invention is concerned with the distribution of this total secondary air to nozzle set 9 for discharge therefrom. Structural control of the total air distribution to nozzle set 9 begins with the establishment of turning vanes 19, 20. These turning vanes are vertically arranged in parallel to each other within section 15 to divide section 15 into channels 21, 22, 23. The present invention proportions the amount of total air between these multiple channels. In determining what proportion of total air goes through each channel, the discharge of the secondary air from nozzle set 9 establishes the horizontal distribution of the total air as it is discharged from nozzle set 9 toward the fireball 3 and the curtain 4 between the fireball and the furnace wall. Given external control of this distribution of the secondary air, the furnace operator is provided with a means to "tune" the all-important secondary air distribution with which to shape the fireball 3 and provide the curtain of air 4 between the fireball and furnace wall, which militates against the impingement of slag on the furnace wall.

Vanes 19, 20 are representative of one or more partitioning means within the transition conduit section 15. The two vanes 19, 20 merely represent typical control of this secondary air flow through the section Additionally, the channels 21, 22, 23 are disclosed as divided by a horizontal vane 24. By such vane means, the three channels 21, 22, 23 are each subdivided vertically. Thus, further control is provided over the distribution and velocity of the secondary air passing through the transition section.

The amount of the total air received in each channel 21, 22, 23, and its velocity, is determined by the amount of obstruction offered to the flow by a valve mounted between the louvers 18 and the nozzle set 9. In FIG. 3, the valve mounted in each channel is disclosed as a flapper. Specifically, channel 21 is provided with a flapper 25, channel 22 is provided with flapper 26, and channel 23 is provided with flapper 27. Each flapper/valve is further divided into two sections, each section mounted in the subchannel established by horizontal vane 24. Mechanical linkage 25', 26', 27' between each flapper/valve section extends to outside of transition section 15 to provide the operator of the furnace manual means with which to mechanically set each secondary air flow. Plenary control of all divisions and velocity of the secondary air through transition section 15 is provided with the result that the nozzle set 9 discharges the secondary air in a pattern of velocity and direction as desired by the furnace operator.

From the foregoing, it will be seen that this invention is one well adapted to attain all of the ends and objects hereinabove set forth, together with other advantages which are obvious and inherent to the apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawings is to be interpreted in an illustrative and not in a limiting sense.

I claim:

1. A system for providing secondary air to a windbox of a tangentially-fired furnace, including, a source of secondary air, a conduit mounted on the furnace wall outside the furnace and connected to the source, a transition conduit section connected to the secondary air conduit extending through the furnace wall and into a vertically tiltable nozzle having multiopneings, at least one turning valve mounted in the transition conduit section upstream of the tiltable nozzle to form a plurality of channels in the transition conduit section, an air flow control structure mounted in each channel formed by the turning vane, and a control means for each air flow control structure arranged to be operated from external the furnace in order to determine the velocity and distribution pattern of the total secondary air supplied to the openings of the nozzle from the channels.

2. The system of claim 1, in which, the transition conduit section between the secondary air conduit mounted on the outside of the furnace is formed into a sharp bend to insert the secondary air into the windbox and the turning vane within the transition conduit section is curved to provide a smooth flow of air to the nozzle.

3. The system of claim 1, wherein, the air flow control system in each channel is in the form of a flapper linked to be positioned by the control means.

4. The system of claim 1, including, an air flow control means for the secondary air mounted between the secondary air conduit and the transition conduit section, and means for controlling the air flow control means for the total air through the transition conduit for combustion within the furnace.

5. A system for providing secondary air to the multiple openings of nozzles mounted in a windbox of a tangentially-fired furnace, including, a source of secondary air, a conduit mounted on the outside of the furnace wall and connected to the source, a transition section connected to the secondary air conduit and extended horizontally through the furnace wall and into the vertically tiltable and multiple-opening nozzles mounted in the windbox, at least one turning vane mounted vertically in the transition section upstream of the tiltable nozzles to form a plurality of channels horizontally side-by-side in the transition section, at least one second turning vane extended horizontally within the transition section to vertically subdivide the side-by-side channels, an air flow constrol structure mounted in each channel subdivision formed by the turning vanes, and a control means for each air flow control structure arranged to be operated externally of the furnace in order to determine the velocity and the portion of the total secondary air supplied through each channel subdivision to predetermined openings of the nozzle.

* * * * *